US006877619B1

(12) United States Patent
Han

(10) Patent No.: US 6,877,619 B1
(45) Date of Patent: Apr. 12, 2005

(54) DEVICE FOR HOLDING TOOTHBRUSH, TOOTHPASTE TUBE AND/OR SOLID SOAP

(76) Inventor: Moon-Key Han, Sinan Apt. 103-709, 384 Muk 1-dong, Jungrang-gu, Seoul (KR), 131-141

( * ) Notice: Subject to any disclaimer, the term of this patent is extended or adjusted under 35 U.S.C. 154(b) by 26 days.

(21) Appl. No.: 10/069,761

(22) PCT Filed: Sep. 1, 2000

(86) PCT No.: PCT/KR00/00992

§ 371 (c)(1),
(2), (4) Date: Feb. 28, 2002

(87) PCT Pub. No.: WO01/15586

PCT Pub. Date: Mar. 8, 2001

(30) Foreign Application Priority Data

Sep. 1, 1999 (KR) ..... 1999/18488

(51) Int. Cl.[7] ..... A47F 7/00

(52) U.S. Cl. ..... 211/65; 211/66; 211/70.6; D6/527; D6/528; D6/530

(58) Field of Search ..... 211/65, 66, 70.6; D6/527, 528, 529, 530, 534, 540

(56) References Cited

U.S. PATENT DOCUMENTS 843,826 A * 2/1907 Kloeppinger
1,831,509 A * 11/1931 Rinehardt
2,099,906 A * 11/1937 Reese et al.
2,805,777 A * 9/1957 Larson ..... 211/70.1
2,974,804 A * 3/1961 Maro ..... 211/70.6
3,304,039 A * 2/1967 Edelman et al.
D256,635 S * 9/1980 Musiano
D259,314 S * 5/1981 Nordlund ..... D6/569
4,488,327 A * 12/1984 Snider
5,097,966 A * 3/1992 Miller ..... 211/87.01
5,427,231 A * 6/1995 Willimann ..... 206/38
5,513,758 A * 5/1996 Lin ..... 211/70.6
5,566,842 A * 10/1996 Dennis ..... 211/65 X
5,617,884 A * 4/1997 Allison ..... 211/65 X
5,921,407 A * 7/1999 Kabanek ..... 211/65
6,199,239 B1 * 3/2001 Dickerson
D458,070 S * 6/2002 Bennett et al. ..... D6/567
6,499,608 B1 * 12/2002 Sterling et al. ..... 211/70.6
6,626,402 B1 * 9/2003 Kaminstein ..... 248/110

FOREIGN PATENT DOCUMENTS

KR 85-9392 U * 12/1985
KR 83-3632 U * 12/1989
KR 92-11138 U * 7/1992

* cited by examiner

*Primary Examiner*—Robert W. Gibson, Jr.
(74) *Attorney, Agent, or Firm*—Robert E. Bushnell, Esq.

(57) ABSTRACT

A toothbrush, toothpaste tube and solid soap keeping set provides a mechanism for installing a toothbrush, toothpaste tube and solid soap used in a bathroom. The toothbrush toothpaste tube and solid soap are installed on one equipment die, which is constructed by combining an equipment die having a plurality of hanger parts formed on a front face thereof and a plurality of stick-in flutes formed on a top surface thereof. The toothbrush, the toothpaste tube and the solid soap each have a ring part hanging on the hanger part and an insertion shaft for insertion into the stick-in flute. Thus, the keeping set can be conveniently used by hanging it on a wall or setting it on a flat part of the bathroom.

3 Claims, 3 Drawing Sheets

DEVICE FOR HOLDING TOOTHBRUSH, TOOTHPASTE TUBE AND/OR SOLID SOAP

TECHNICAL FIELD

The present invention relates to a toothbrush, toothpaste tube and solid soap keeping set, and more particularly, to a toothbrush, toothpaste tube and solid soap keeping set provided as one equipment die with a toothbrush, a toothpaste tube and solid soap (hereinafter, referred to as "bathroom goods") used in a bathroom.

BACKGROUND ART

In general, bathroom goods are used in such a state that the goods are individually placed on a washstand or are inserted into a receptacle. There is an inconvenience in that the bathroom goods occupy a relatively large area when they are placed on the washstand, or an inconvenience is experienced when searching for the goods when they are stuck into the receptacle.

DISCLOSURE OF THE INVENTION

Accordingly, the present invention is directed to a toothbrush, toothpaste tube and solid soap keeping set that substantially obviates one or more of the limitations and disadvantages of the related art.

A primary object of the present invention is to provide a toothbrush, toothpaste tube and solid soap keeping set having an equipping unit by means of which bathroom goods can be stuck into or hooked onto one equipment die in order to retain and manage the bathroom goods.

BRIEF DESCRIPTION OF THE DRAWINGS

The above and other objects and features of the instant invention will become apparent from the following description of preferred embodiments taken in conjunction with the accompanying drawings, in which.

BEST MODE FOR CARRYING OUT THE INVENTION

Reference will now be made in detail to the preferred embodiments of the present invention, embodiments of which are illustrated in the accompanying drawings.

Figure 1:
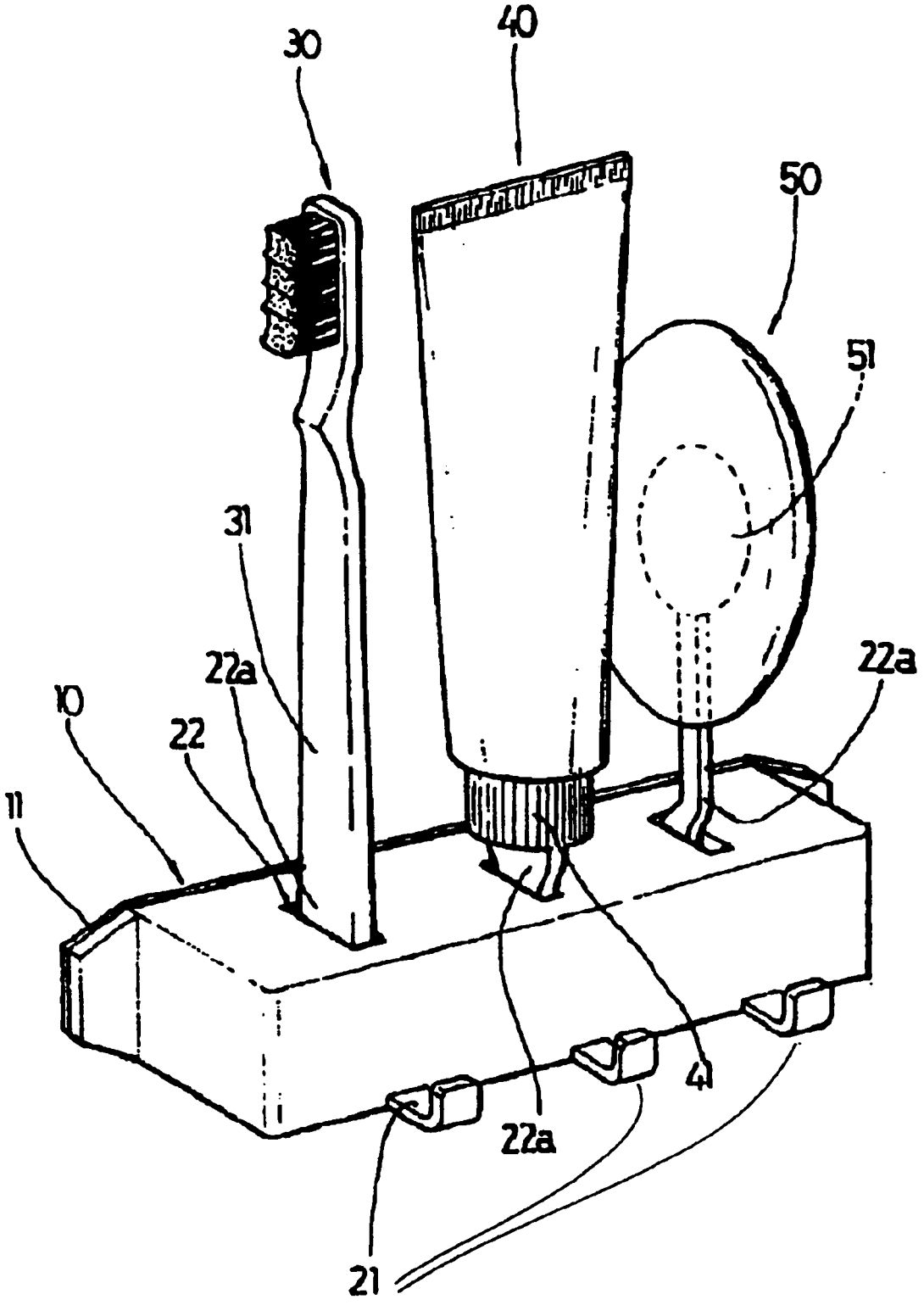
FIG. 1 is a perspective view of a first embodiment of the present invention in a first mode of use.
Figure 2:
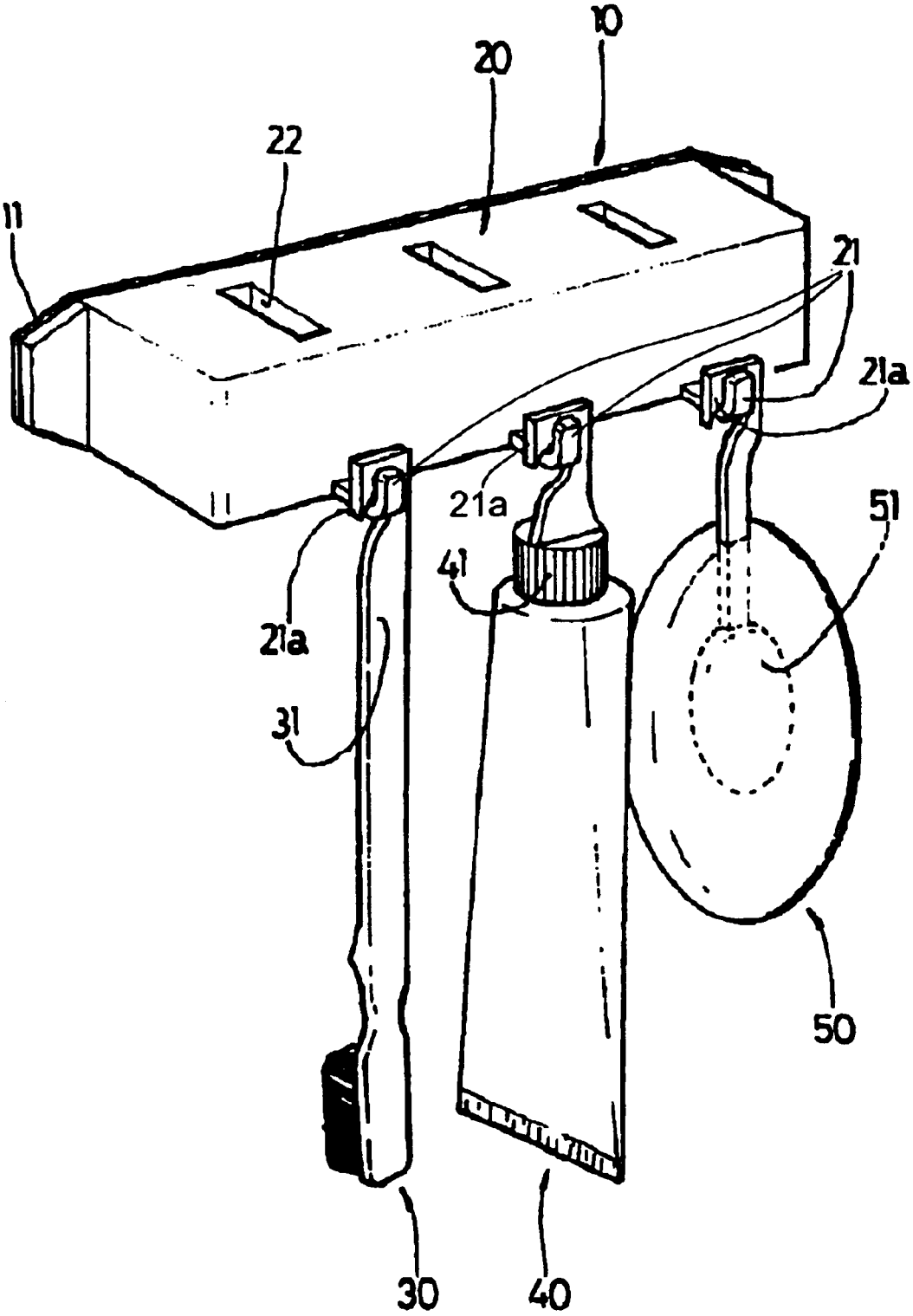
FIG. 2 is a perspective view of the first embodiment of the present invention in a second mode of use.
Figure 3:
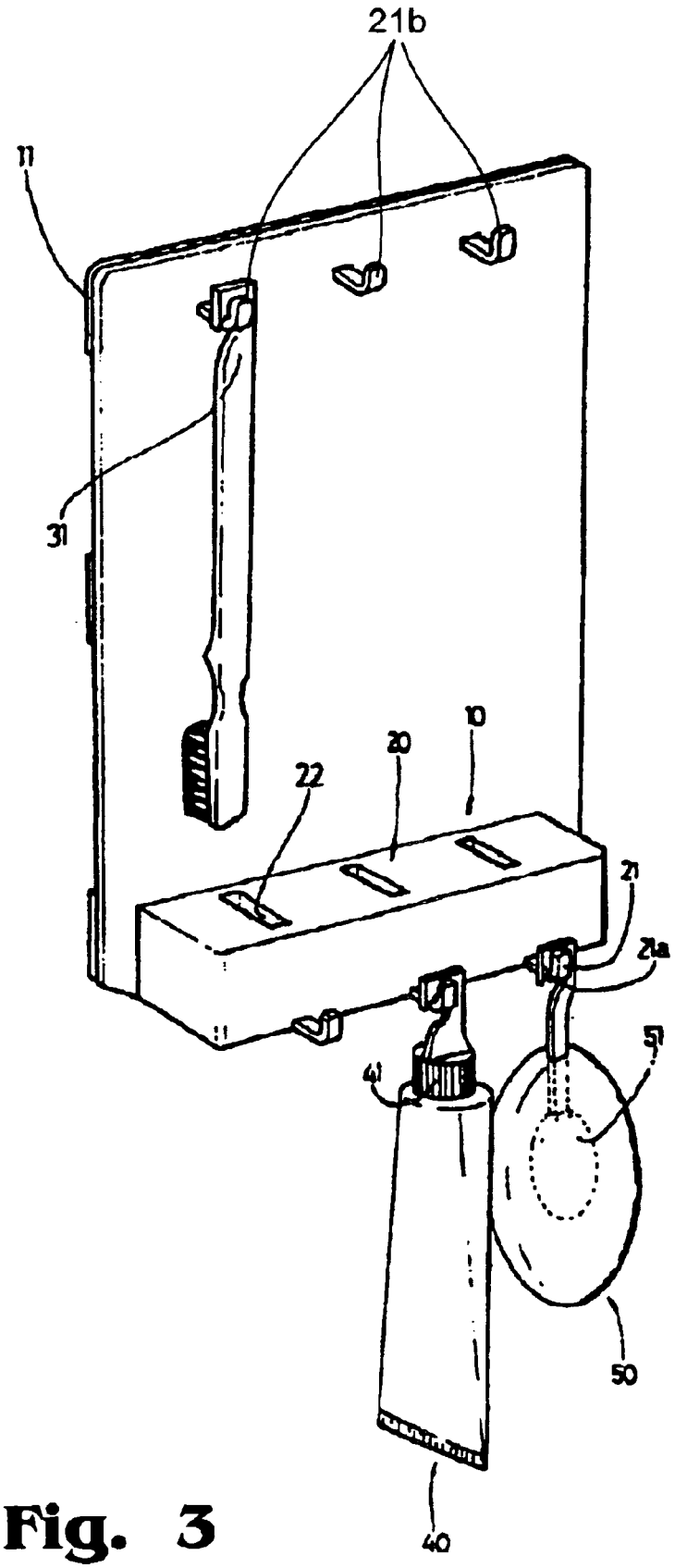
FIG. 3 is a perspective view of a second embodiment of the present invention.

In accordance with the present invention, as shown in FIGS. 1 and 2, a toothbrush, toothpaste tube and solid soap keeping set is constructed in the form of an equipment die 10 having a plurality of hanger parts 21 formed on a front face and stick-in flutes 22 formed on an upper face thereof, and by a toothbrush 30, a toothpaste tube 40 and solid soap 50, wherein each of the toothbrush 30, the toothpaste tube 40 and the solid soap 50 has a ring part 21*a* (FIG. 2) hung on the hanger part 21 and an insertion shaft 22*a* (FIG. 1) inserted into the stick-in flute 22. The toothbrush 30 is provided with the ring part 21*a* and the insertion shaft 22*a* formed on a lower part of a handle 31, and the toothpaste tube 40 has the ring part 21*a* and the insertion shaft 22*a* formed on a top of a cover 41, while the solid soap 50 has the ring part 21*a* and the insertion shaft 22*a* which are formed on one end of a part projecting from one side of a support body 51 and installed inside the soap. In the embodiment of FIG. 3, a back face 11 of the equipment die 10 is extended and projected upward, and on its front face, a plurality of hanger parts 21*b* are formed.

INDUSTRIAL APPLICABILITY

As mentioned above, in accordance with the present invention, one equipment die 10 is equipped with the plurality of hanger parts 21 and stick-in flutes 22, and the ring parts 21*a* and the insertion shafts 22*a* provided with the toothbrush 30, the toothpaste tube 40 and the solid soap 50 are selectively hung on the hanger parts 21 or stuck into the stick-in flutes 22. Accordingly, there is a convenience when selectively using the toothbrush, the tothpaste tube and the solid soap.

Although the invention has been shown and described with respect to the preferred embodiments, it will be understood by those skilled in the art that various changes and modifications may be made without departing from the spirit and scope of the invention as defined in the following claims.

What is claimed is:

1. A device for holding at least one of a toothbrush, a toothpaste tube and a solid soap, said device comprising an equipment die having a plurality of hanger parts formed on a front face of said equipment die and a plurality of stick-in flutes formed on an upper face of said equipment die, wherein each said at least one of the toothbrush, the toothpaste tube and the solid soap has a ring part which can be hung on one of the hanger parts and an insertion shaft which can be inserted into one of the stick-in flutes;

wherein said equipment die has a plurality of additional hanger parts formed on a front surface of an extension extending upward from a rear face of said equipment die, and wherein the ring part of each said at least one of the toothbrush, the toothpaste tube and the solid soap can be hung on one of the additional hanger parts.

2. A device for holding at least one of a toothbrush, a toothpaste tube and a solid soap, said device comprising an equipment die having a plurality of stick-in flutes formed on an upper face of the equipment die, wherein each said at least one of the toothbrush, the toothpaste tube and the solid soap has an insertion shaft which can be inserted into one of the stick-in flutes, and wherein said equipment die has a plurality of hanger parts formed on a front surface of an extension extending upward from a rear face of said equipment die, each said at least one of the toothbrush, the toothpaste tube and the solid soap having a ring part which can be hung on one of the hanger parts.

3. A device for holding at least one of a toothbrush, a toothpaste tube and a solid soap, said device comprising an equipment die having a plurality of hanger parts formed on a front surface of an extension extending upward from a rear face of said equipment die, wherein each said at least one of the toothbrush, the toothpaste tube and the solid soap has a ring part which can be hung on one of the hanger parts;

wherein said equipment die has a plurality of additional hanger parts formed on a front face of said equipment die, and wherein the ring part of each said at least one of the toothbrush, the toothpaste tube and the solid soap can be hung on one of the additional hanger parts.

* * * * *